US010151522B2

(12) United States Patent
Junge et al.

(10) Patent No.: US 10,151,522 B2
(45) Date of Patent: Dec. 11, 2018

(54) MICROCHANNEL CONDENSER AND DUAL EVAPORATOR REFRIGERATION SYSTEM

(71) Applicant: General Electric Company, Schenectady, NY (US)

(72) Inventors: Brent Alden Junge, Evansville, IN (US); Michael John Kempiak, Osceola, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 322 days.

(21) Appl. No.: 15/007,521

(22) Filed: Jan. 27, 2016

(65) Prior Publication Data

US 2017/0211868 A1 Jul. 27, 2017

(51) Int. Cl.

| | |
|---|---|
| ***F25D 11/02*** | (2006.01) |
| ***F25B 39/04*** | (2006.01) |
| ***F25B 5/02*** | (2006.01) |
| ***F25B 5/00*** | (2006.01) |
| ***F25B 40/00*** | (2006.01) |
| *F25D 17/06* | (2006.01) |

(52) U.S. Cl.

CPC ..... *F25D 11/022* (2013.01); *F25B 5/00* (2013.01); *F25B 5/02* (2013.01); *F25B 39/04* (2013.01); *F25B 40/00* (2013.01); *F25B 2400/052* (2013.01); *F25B 2400/054* (2013.01); *F25D 17/065* (2013.01)

(58) Field of Classification Search

CPC ..... F25D 11/022; F25D 17/065; F25D 11/02; F25B 39/04; F25B 2339/0444; F25B 6/02

See application file for complete search history.

(56) References Cited

U.S. PATENT DOCUMENTS

| | | | | |
|---|---|---|---|---|
| 2,682,756 A * | 7/1954 | Clark | F25B 5/00 62/335 |
| 5,235,820 A | 8/1993 | Radermacher et al. | |
| 5,752,566 A | 5/1998 | Liu et al. | |
| 5,848,537 A | 12/1998 | Biancardi et al. | |
| 6,138,460 A | 10/2000 | Lee | |

(Continued)

FOREIGN PATENT DOCUMENTS

| | | |
|---|---|---|
| CN | 1121168 A | 4/1996 |
| CN | 1209533 A | 3/1999 |

(Continued)

*Primary Examiner* — Elizabeth Martin

(74) *Attorney, Agent, or Firm* — Dority & Manning, P.A.

(57) ABSTRACT

A microchannel condenser includes a first header, the first header including a body defining an interior and further defining an inlet bore and a first outlet bore, and a second header spaced apart from the first header, the second header including a body defining an interior and further defining a second outlet bore. The microchannel condenser further includes a conduit in fluid communication with the second outlet bore. The microchannel condenser further includes a plurality of tubes extending between the first header and the second header, each of the plurality of tubes defining a plurality of microchannels, each of the plurality of microchannels in fluid communication with the interior of the first header and the interior of the second header, each of the plurality of microchannels having a maximum cross-sectional width of less than or equal to 5 millimeters.

19 Claims, 7 Drawing Sheets

(56) References Cited

U.S. PATENT DOCUMENTS

| | | | | |
|---|---|---|---|---|
| 6,405,548 | B1 | 6/2002 | Hollenbeck | |
| 6,684,661 | B1 | 2/2004 | Beasley et al. | |
| 6,694,754 | B1 | 2/2004 | Schenk et al. | |
| 6,725,680 | B1 | 4/2004 | Schenk et al. | |
| 2002/0134095 | A1 | 9/2002 | Temmyo et al. | |
| 2005/0132733 | A1 | 6/2005 | Rafalovich et al. | |
| 2006/0168996 | A1 | 8/2006 | Imai et al. | |
| 2014/0007611 | A1* | 1/2014 | Jeon | F25D 11/02 62/419 |
| 2014/0298854 | A1* | 10/2014 | Junge | F25B 5/02 62/498 |

FOREIGN PATENT DOCUMENTS

| | | | |
|---|---|---|---|
| EP | 0541328 | A1 | 3/1992 |
| EP | 0816779 | A1 | 1/1998 |
| EP | 2386812 | A2 | 11/2011 |
| JP | 07103488 | A | 4/1995 |
| JP | 09236337 | A | 9/1997 |
| JP | 2003254661 | A | 9/2003 |
| WO | WO2012024102 | A2 | 2/2012 |

* cited by examiner

MICROCHANNEL CONDENSER AND DUAL EVAPORATOR REFRIGERATION SYSTEM

FIELD OF THE INVENTION

The subject matter of the present disclosure relates generally to a microchannel condenser for use with a refrigeration system that may utilize dual evaporators and a zeotropic refrigerant mixture.

BACKGROUND OF THE INVENTION

Conventional refrigerator appliances commonly utilize a single evaporator, fan, and damper to move cooled air from the frozen food compartment containing the evaporator to the fresh food compartment. The position of the damper can be controlled depending upon whether cooling of the fresh food compartment is needed. One or more temperature sensors are utilized to measure temperature in one or more of the compartments.

Refrigeration systems that use dual evaporators can be useful for removing heat from two different locations. For example, in a refrigerator appliance, a refrigeration loop can be provided that uses one evaporator to remove heat from the fresh food compartment and another evaporator to remove heat from the frozen food compartment. Such dual evaporator systems can be useful in e.g., avoiding temperature and/or humidity gradients that can occur with single evaporator systems.

Dual evaporator refrigeration systems can be costly and more complex than single evaporator refrigeration systems. Dual evaporator refrigeration systems can also incur cycling losses when switching operation from the fresh food evaporator to the freezer evaporator. Evaporators in such existing systems are also known to be relatively large, which can impact the energy efficiency of the appliance in which the refrigeration system resides. Some dual evaporator systems also utilize dual compressors, which further increases energy usage and inefficiency.

Accordingly, a refrigeration system that can provide for improved efficiency in operation and reduced complexity in manufacture would be useful. Such a refrigeration system that can cool multiple locations to different temperatures at the same time would be particularly useful. Such a refrigeration system that can use a single compressor and condenser would also be beneficial.

BRIEF DESCRIPTION OF THE INVENTION

The present disclosure provides a microchannel condenser and a refrigeration system that uses a microchannel condenser, dual evaporators and a zeotropic refrigerant mixture to provide more efficient cooling. The refrigeration system can be used in e.g., a refrigerator having a fresh food compartment and a frozen food compartment to provide separate cooling for each compartment. Multiple exemplary embodiments are described including embodiments utilizing a single compressor and a single condenser with dual evaporators. Additional aspects and advantages of the invention will be set forth in part in the following description, or may be apparent from the description, or may be learned through practice of the invention.

In one exemplary embodiment, the present disclosure provides a refrigeration system that includes a zeotropic refrigerant for circulation therein. A compressor provides for a pressurized flow of the refrigerant. A microchannel condenser is configured to receive and cool the flow of pressurized refrigerant. The microchannel condenser includes a first header, the first header including a body defining an interior and further defining an inlet bore and a first outlet bore, and a second header spaced apart from the first header, the second header including a body defining an interior and further defining a second outlet bore. The microchannel condenser further includes a plurality of tubes extending between the first header and the second header, each of the plurality of tubes defining a plurality of microchannels, each of the plurality of microchannels in fluid communication with the interior of the first header and the interior of the second header, each of the plurality of microchannels having a maximum cross-sectional width of less than or equal to 5 millimeters. The pressurized refrigerant is separated in the interior of the second header into a first refrigerant stream and a second refrigerant stream. The first refrigerant stream is flowable from the interior of the second header into the microchannels of a portion of the plurality of tubes. The second refrigerant stream is flowable from the interior of the second header through the second outlet bore. A first expansion device is in receipt of the first refrigerant stream from the condenser and is configured for reducing the pressure of the first refrigerant stream. A second expansion device is in receipt of the second refrigerant stream from the condenser and is configured for reducing the pressure of the second refrigerant stream. A first evaporator is configured to receive and evaporate at least a portion of the first refrigerant stream. A second evaporator is configured to receive and evaporate at least a portion of the second refrigerant stream.

In another exemplary embodiment, the present disclosure provides a microchannel condenser for receiving and cooling a flow of pressurized refrigerant is provided. The microchannel condenser includes a first header, the first header including a body defining an interior and further defining an inlet bore and a first outlet bore, and a second header spaced apart from the first header, the second header including a body defining an interior and further defining a second outlet bore. The microchannel condenser further includes a conduit in fluid communication with the second outlet bore. The microchannel condenser further includes a plurality of tubes extending between the first header and the second header, each of the plurality of tubes defining a plurality of microchannels, each of the plurality of microchannels in fluid communication with the interior of the first header and the interior of the second header, each of the plurality of microchannels having a maximum cross-sectional width of less than or equal to 5 millimeters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures denotes the same or similar features.

DETAILED DESCRIPTION OF THE INVENTION

Figure 1:
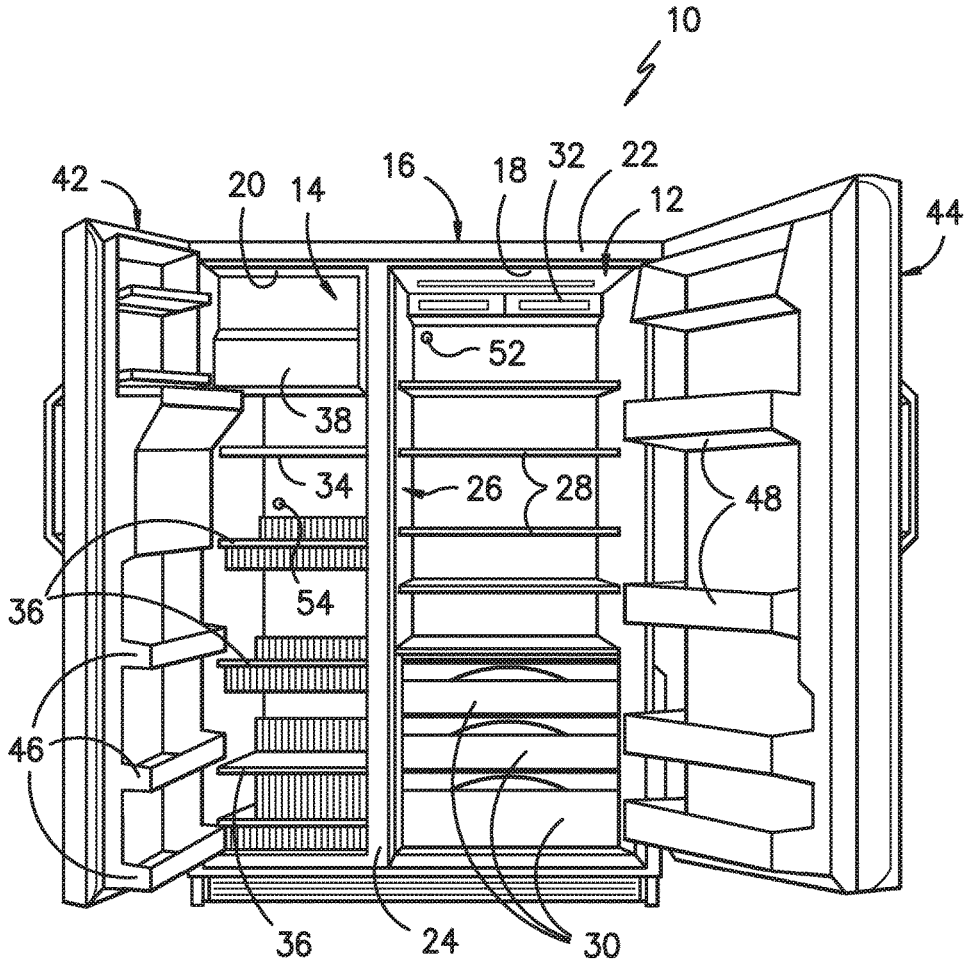
FIG. 1 illustrates an exemplary embodiment of a refrigerator appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a representative refrigerator 10 in an exemplary embodiment of the present invention. More specifically, for illustrative purposes, the present invention is described with a refrigerator 10 having a construction as shown and described further below. As used herein, a refrigerator includes appliances such as a refrigerator/freezer combination, side-by-side, bottom mount, compact, and any other style or model of a refrigerator. Accordingly, other configurations including multiple and different styled compartments could be used with refrigerator 10, it being understood that the configuration shown in FIG. 1 is by way of example only. Additionally, the refrigeration system of the present invention is not limited to a refrigerator appliance and can be used in other applications where dual evaporators are desirable as well such as e.g., where separate cooling at two or more locations is desired.

Refrigerator 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator 10 includes shelves 28 and slide-out storage drawers 30, sometimes referred to as storage pans, which normally are provided in fresh food compartment 12 to support items being stored therein.

Refrigerator 10 can be operated by one or more controllers (not shown) or other processing devices according to programming and/or user preference via manipulation of a control interface 32 mounted e.g., in an upper region of fresh food storage compartment 12 and connected with the controller. The controller may include one or more memory devices and one or more microprocessors, such as a general or special purpose microprocessor operable to execute programming instructions or micro-control code associated with the operation of the refrigerator. The memory may represent random access memory such as DRAM, or read only memory such as ROM or FLASH. In one embodiment, the processor executes programming instructions stored in memory. The memory may be a separate component from the processor or may be included onboard within the processor. As used herein, "controller" includes the singular and plural forms.

The controller may be positioned in a variety of locations throughout refrigerator 10. In the illustrated embodiment, the controller may be located e.g., behind an interface panel 32 or doors 42 or 44. Input/output ("I/O") signals may be routed between the control system and e.g., temperature sensors 52 and 54 as well as various operational components of refrigerator 10. These signals can be provided along wiring harnesses that may be routed through e.g., the back, sides, or mullion 24. Typically, through user interface panel 32, a user may select various operational features and modes and monitor the operation of refrigerator 10. In one embodiment, the user interface panel may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. The user interface panel may be in communication with the controller via one or more signal lines or shared communication busses.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. Freezer door 42 includes a plurality of storage shelves 46, and fresh food door 44 includes a plurality of storage shelves 48.

Refrigerator 10 includes a machinery compartment that incorporates at least part of refrigeration cycle 100—exemplary embodiments of which are depicted in each of FIGS. 2, 3, 4, and 5. For each embodiment, refrigeration cycle 100 includes a first evaporator 140 and a second evaporator 150. By way of example, first evaporator 140 can be used to cool frozen food (FZ) compartment 14 and second evaporator 150 can be used to cool fresh food (FF) compartment 12. A fan 152 can be used to circulate air in compartment 14 over first evaporator 140. Similarly, a fan 142 can be used to circulate air in compartment 12 over second evaporator 150. Alternatively, refrigeration system 100 can be used in other appliances where e.g., evaporators 140 and 150 are positioned in different locations where cooling to different temperatures is desired.

Each refrigeration system 100 depicted in the exemplary embodiments of FIGS. 2, 3, 4, and 5 is charged with a zeotropic refrigerant mixture, which is a mixture of two or more refrigerants that have different saturated liquid temperatures at the same pressure. Consequently, the concentrations of the individual refrigerants between the liquid and vapor phases are typically different when the refrigerant mixture is vaporized or boiled. In addition, zeotropic refrigerant mixtures typically exhibit temperature glide—meaning that the saturated liquid temperature of the zeotropic refrigerant changes as the relative compositions of refrigerants in the liquid mixture changes during vaporization.

Examples of non-flammable refrigerants that can be used in a zeotropic mixture include, but are not limited, to R-134a, R245fa, R245ca and small amounts of R-600, R-600a or R-1234yf. Examples of refrigerants that may be used in a zeotropic mixture with low Global Warming Potential (GWP) include R-600, R-600a, pentane, R290 and R-1234yf. Different mixture percentages of such refrigerants can be used in the dual evaporator refrigerant system 100 as will be further described below. In one embodiment, the zeotropic refrigerant includes two or more refrigerants selected from a group consisting of an R-134a refrigerant, an R-245fa refrigerant, an R-245ca refrigerant, an R-1234yf refrigerant, an R-600 refrigerant, an R-600a refrigerant, ethane, pentane, butane, and propane.

Still referring to FIGS. 2, 3, 4, and 5, in each embodiment compressor 104 receives an inlet refrigerant flow 130 (i.e. of the zeotropic refrigerant) and provides for a flow 106 of pressurized refrigerant to a microchannel condenser 108. Flow 106 and flow 130 are both in the form of a superheated vapor. However, the pressure of the superheated vapor in flow 106 is much higher than flow 130 and can be condensed into liquid in the microchannel condenser 108.

In one embodiment, the refrigerant mixture exiting compressor 104 in flow 106 can be about 30% R-134a and about 70% R-600a (i.e., a percent ratio of 30/70), at a temperature of about 117 degrees (Fahrenheit) and a pressure of about 114 psia. R-134a has a higher vapor saturation temperature than R-600a, i.e., the temperature at which R-134a refrigerant changes from a gas back to a liquid is higher than the temperature at which R-600a changes from a gas back to a liquid when subject to the same pressure. In another embodiment, the refrigerant mixture exiting compressor 104 in flow 106 can be about 30% R-134a and about 70% R-245fa (i.e., a percent ratio of 30/70), at a temperature of about 117 degrees (Fahrenheit) and a pressure of about 114 psia. R-134a has a lower boiling point and a lower condensation temperature than R-245fa, i.e., the temperature at which R-134a refrigerant changes from a gas back to a liquid is lower than the temperature at which R-245fa changes from a gas back to a liquid when subject to the same pressure.

In microchannel condenser 108, the pressurized flow from compressor 104 is cooled by e.g., exchanging heat with the environment of refrigeration system 100. For example, in the case of refrigerator 10, microchannel condenser 108 may exchange heat with ambient air from the room in which refrigerator 10 is located. Fan 170 may be used to flow air over e.g., coils, fins, and/or other elements making up microchannel condenser 108.

Figure 6:
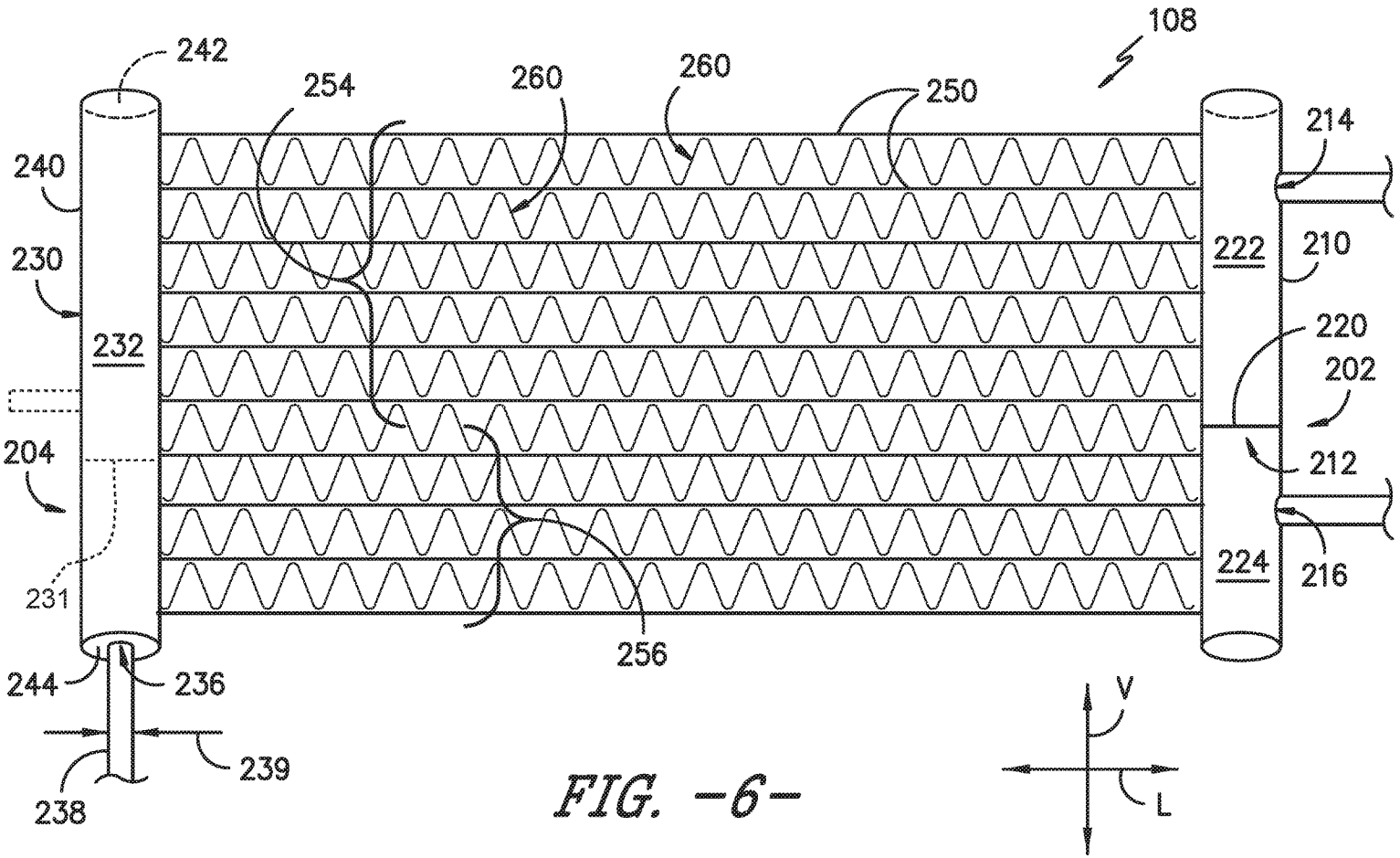
FIG. 6 is a front sectional view of an exemplary embodiment of a microchannel condenser.
Figure 7:
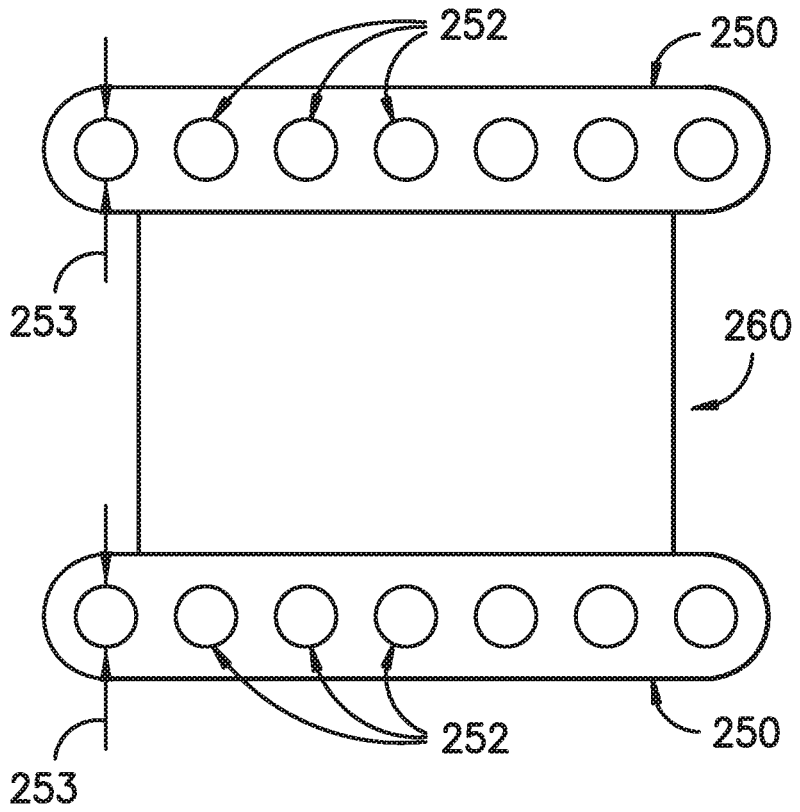
FIG. 7 is a cross-sectional view of an exemplary embodiment of tubes and a fin of a microchannel condenser.

Referring now additionally to FIGS. 6 and 7, embodiments of a microchannel condenser 108 are provided. The microchannel condenser 108 includes a first header 202 and a second header 204 which is spaced apart from the first header 202, such as along a longitudinal direction L. The first header 202 includes a body 210 which defines an interior 212. Further, an inlet bore 214 and a first outlet bore 216 are each defined in the body 210. The inlet bore 214 may receive the pressurized refrigerant flow from compressor 104. The first outlet bore 216 may exhaust a portion of the refrigerant, such as a first refrigerant stream 112 as discussed herein, therefrom for flow to a first expansion device 124.

Additionally, in exemplary embodiments, one or more partitions 220 may be disposed within the interior 212. Each partition 220 may divide and fluidly isolate portions of the interior 212 from each other. For example, a single partition 220 as shown may divide the interior 212 into a first interior portion 222 and a second interior portion 224. More than one partition 220 may be utilized, thus dividing the interior 212 into three or more interior portions 224. The inlet bore 214 may be in fluid communication with one of the interior portions, such as first interior portion 222, and may thus be defined in the portion of the body 210 defining this interior portion. The first outlet bore 216 may be in fluid communication with another of the interior portions, such as second interior portion 224, and may thus be defined in the portion of the body 210 defining this interior portion.

The second header 204 includes a body 230 which defines an interior 232. Further, a second outlet bore 236 may be defined in the body 230. The second outlet bore 236 may exhaust a portion of the refrigerant, such as a second refrigerant stream 114 as discussed herein, therefrom for flow to a second expansion device 126. For example, a conduit 238 may be connected to and in fluid communication with the second outlet bore 236, and may thus flow the second refrigerant stream 114 therefrom.

In exemplary embodiments, the conduit 238 may have a maximum cross-sectional width (such as a maximum diameter) 239 of greater than the maximum cross-sectional width of the microchannels of condenser 108, as discussed herein. For example, the maximum cross-sectional width 239 may be greater than 5 millimeters, such as greater than 10 millimeters, such as greater than 20 millimeters.

Additionally, in embodiments wherein more than one partition 220 is utilized, one or more partitions may be disposed within the interior 232. Each partition may divide and fluidly isolate portions of the interior 232 from each other. For example, a single partition 231 (as shown as a phantom line in FIG. 6) may divide the interior 232 into a first interior portion and a second interior portion. More than one partition may be utilized, thus dividing the interior 232 into three or more interior portions. The second outlet bore 236 may be in fluid communication with one of the interior portions, such as the first or second interior portion, and may thus be defined in the portion of the body defining this interior portion.

As discussed herein, the second refrigerant stream 114 may be a liquid. Accordingly, for the second refrigerant stream 114 to flow through the second outlet bore 236, the second outlet bore 236 may be located at a relatively low position (along a vertical axis V), such as a lower-most position, along the body 230 or portion thereof. For example, in some embodiments, body 230 may include one or more sidewalls 240, a top wall 242 and a bottom wall 244. The second outlet bore 236 may be defined in the bottom wall 244.

Microchannel condenser 108 further includes a plurality of tubes 250, each of which extends between and is in fluid communication with the first header 202 and the second header 204. For example, each tube 250 may extend along the longitudinal direction between the first header 202 and second header 204. Each tube 250 may define a plurality of microchannel 252, which may for example be aligned in a row or linear array. Each microchannel 252 may extend between and provide the fluid communication with the first header 202 and the second header 204, such as the interiors 212, 232 thereof inlets and outlets of the microchannels 252 may thus be defined in the bodies 210, 230 to facilitate this fluid communication. In general, refrigerant flows between the first header 202 (such as the interior 212 thereof) and the second header 204 (such as the interior 232 thereof) through the microchannels 252.

Each microchannel 252 has a relatively small maximum cross-sectional width (such as a maximum diameter) 253. For example, each microchannel 252 may have a maximum cross-sectional width 253 of less than or equal to 5 millimeters, such as less than or equal to 3 millimeters, such as less than or equal to 2 millimeters, such as less than or equal to 1.5 millimeters.

As discussed, refrigerant flows between the first header 202 (such as the interior 212 thereof) and the second header 204 (such as the interior 232 thereof) through the microchannels 252. In particular, the tubes 250 (and microchannels 252) thereof are divided into two or more portions of tubes 250. Each portion includes one or more tubes 250. Refrigerant generally flows through the microchannels 252 of a portion of the tubes 250 either from the first header 202 to the second header 204 or from the second header 204 to the first header 202. For example, as illustrated, microchannel condenser 108 may include a first portion 254 of tubes 250 and a second portion 256 of tubes 250. Refrigerant generally flows from the interior 212 (such as the first interior portion 222) of the first header 202 through the microchannels 252 of the first portion 254 of tubes 250 and into the interior 232 of the second header 204. Refrigerant may further generally flow from the interior 232 of the second header 204 through the microchannels 252 of the second portion 256 of tubes 250 and into the interior 212 (such as the second interior portion 224) of the first header 202. In some embodiments, more than two portions of tubes 250 may be utilized, and refrigerant generally may continue flowing back and forth between the interior 212 of the first header 202 and the interior 232 of the second header 204.

Microchannel condenser 108 further advantageously separates the pressurized refrigerant into a first refrigerant stream 112 and a second refrigerant stream 114. In particular, the pressurized refrigerant is separated in the interior 232 (such as in some embodiments a portion thereof) of the second header 204 into a first refrigerant stream 112 and a second refrigerant stream 114. Each stream 112 and 114 has a different composition of the zeotropic refrigerant mixture. For example, if the zeotropic refrigerant mixture includes a mixture of R-134A and R-600a, refrigerant stream 112 could have a different ratio of R-134a to R-600a than refrigerant stream 114. If the zeotropic refrigerant mixture includes a mixture of R-134A and R-245fa, refrigerant stream 112 could have a different ratio of R-134a to R-245fa than refrigerant stream 114.

The microchannel condenser 108 generally, and in particular the headers 202, 204 and tubes 250 (and microchannels 252 thereof), are generally configured so the velocity of refrigerant passing through allows a liquid layer 120 to form in the bottom of interior 232 (or a portion thereof) due to the force of gravity and a vapor 122 rises to the top. The vapor 122 in interior 232 flows as first refrigerant stream 112 from interior 232 into and through the microchannels 252 of a portion (such as a second portion as discussed herein) of the tubes 250. This stream 112 may eventually be exhausted from the microchannel condenser 108 through first outlet bore 216. The liquid 120 in interior 232 flows as second refrigerant stream 114 from interior 232 through the second outlet bore 236, such as into conduit 238.

Separation into the first refrigerant stream 112 and the second refrigerant stream 114 occurs in the interior 232 (such as a portion thereof if partitions are utilized in the interior 232) after refrigerant has flowed into the interior 232 from a portion of the tubes 250. For example, in some embodiments as illustrated, separation may occur after the flow of refrigerant into the interior 232 from the first portion 254 of tubes 250 and before flow of refrigerant from the interior 232 into the second portion 256 of tubes 250. Accordingly, the refrigerant flow from the interior 232 into the second portion 256 (or another portion that flows refrigerant from interior 232 to interior 212) is the first refrigerant stream 112.

By way of example, where the zeotropic refrigerant mixture is R-134a and R-600a, second refrigerant stream 114 exits a separating component (e.g., second header 204) of condenser 108 at about 44.5% R-134a and about 55.5% R-600a (i.e., a percent ratio of 44.5/55.5), at a temperature of about 105 degrees (Fahrenheit) and a pressure of about 114 psia. First refrigerant stream 112 exits condenser 108 at about 15.5% R-134a and about 84.5% R-600a (i.e., a percent ratio of 15.5/84.5) at a temperature of about 94 degrees (Fahrenheit) and a pressure of about 114 psia. Where the zeotropic refrigerant mixture is R-134a and R-245fa, second refrigerant stream 114 exits second outlet bore 236 of condenser 108 at about 44.5% R-134a and about 55.5% R-245fa (i.e., a percent ratio of 44.5/55.5), at a temperature of about 105 degrees (Fahrenheit) and a pressure of about 114 psia. First refrigerant stream 112 exits first outlet bore 216 at about 15.5% R-134a and about 84.5% R-245fa (i.e., a percent ratio of 15.5/84.5) at a temperature of about 94 degrees (Fahrenheit) and a pressure of about 114 psia.

Microchannel condenser 108 may additionally include one or more sets of fins 260 which facilitate increased heat exchange. Each fin or set of fins 260 may be disposed between and in contact with neighboring tubes 250. For example, a set of fins 260 may be provided in a louvered or folded arrangement between the neighboring tubes 250 as illustrated.

Continuing with FIGS. 2, 3, 4, and 5, first expansion device 124 receives first refrigerant stream 112 from condenser 108. First expansion device 124 is configured to reduce the pressure of first refrigerant stream 112. Similarly, second expansion device 126 is configured to reduce the pressure of second refrigerant stream 114. In one exemplary embodiment of the present invention, expansion device 124 and/or 126 include a capillary tube as will be understood by one of skill in the art using the teachings disclosed herein. Other expansion devices may be used as well.

As already indicated, the above description applies to each of the exemplary embodiments of FIGS. 2, 3, 4, and 5. In the description that follows, each exemplary embodiment in such figures will now be described—particularly the differences between such exemplary embodiments.

Figure 2:
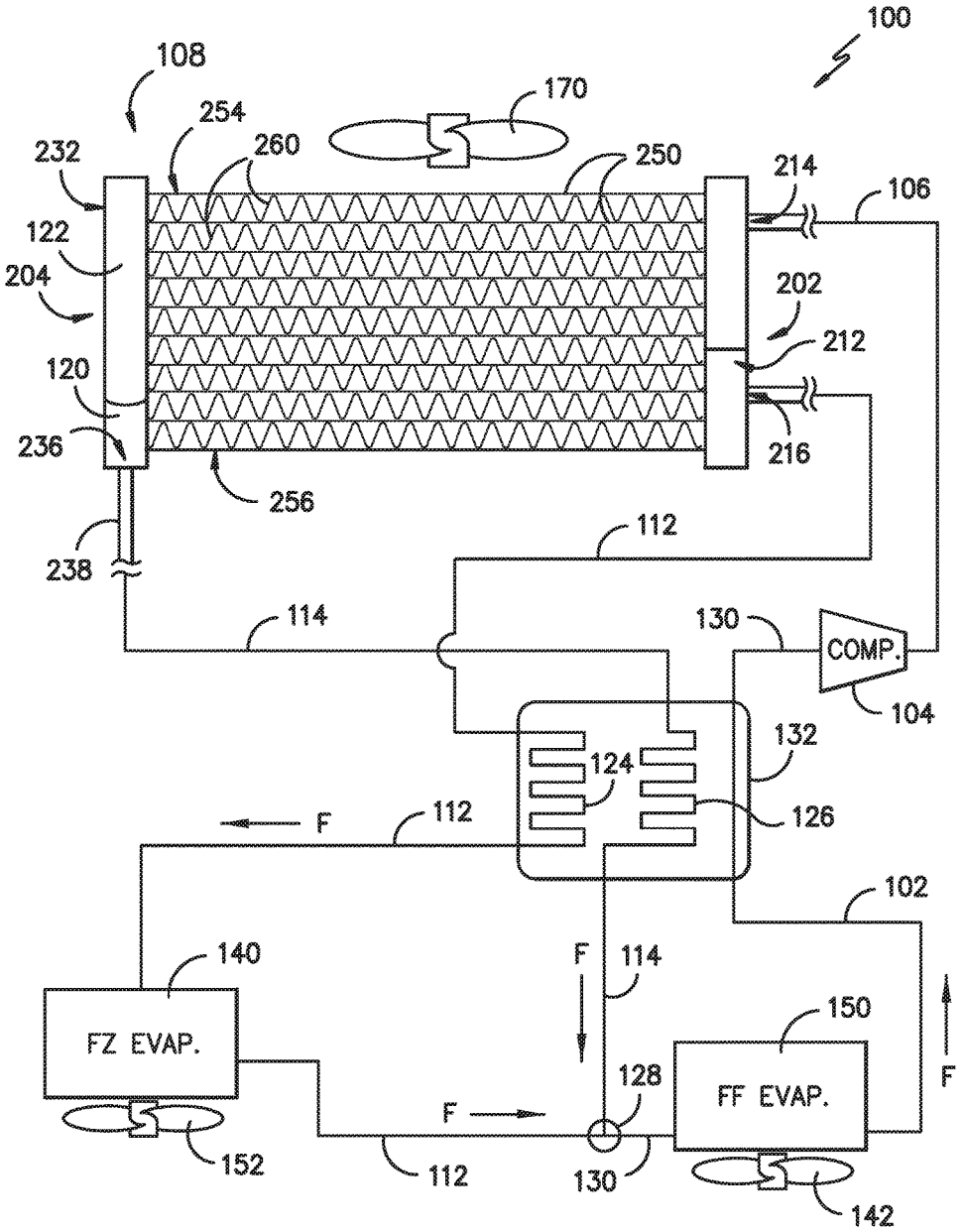
FIGS. 2, 3, 4, and 5 each illustrate a schematic of an exemplary embodiment of a refrigeration system of the present invention as may be used in e.g., a refrigerator appliance such as that shown in FIG. 1.

Continuing with FIG. 2, first evaporator 140 receives first refrigerant stream 112 from first expansion device 124 and operates to evaporate at least a portion of stream 112. This evaporation process provides cooling that can be used to e.g., remove heat from frozen food (FZ) compartment 14. A junction 128 joins first refrigerant stream 112 from first evaporator 140 and second refrigerant stream 114 from second expansion device 126 to create a combined refrigerant stream 130. Because streams 112 and 114 are at substantially the same pressure, these streams can be joined at junction 128 without special devices such as a valve or venturi.

Second evaporator 150 receives and evaporates at least a portion of the combined refrigerant stream 130 and provides the same as an inlet refrigerant flow 130 to compressor 104. The evaporation of combined refrigerant stream 130 in second evaporator 150 provides cooling that can be used to e.g., remove heat from fresh food (FF) compartment 12.

As indicated by block 132, first and second expansion devices 124 and 126 are in thermal communication with inlet refrigerant flow 130 to compressor 104 so as to cool first refrigerant stream 112 and second refrigerant stream 114. Block 132 may be e.g., a heat exchanger or a section where tubing making up devices 124, 126, and flow 132 are located near one another so as to promote the conduction of heat. Other configurations to exchange heat therebetween may be used as well. Compressor 104 is used to pressurize inlet refrigerant flow 130 from second evaporator 150 and repeat the cycle as previously described.

In addition to other advantages, the exemplary embodiment of refrigeration system 100 depicted in FIG. 2 can also provide advantages in the layout or construction of plumbing and/or components in a refrigerator appliance such as refrigerator 10.

Figure 3:
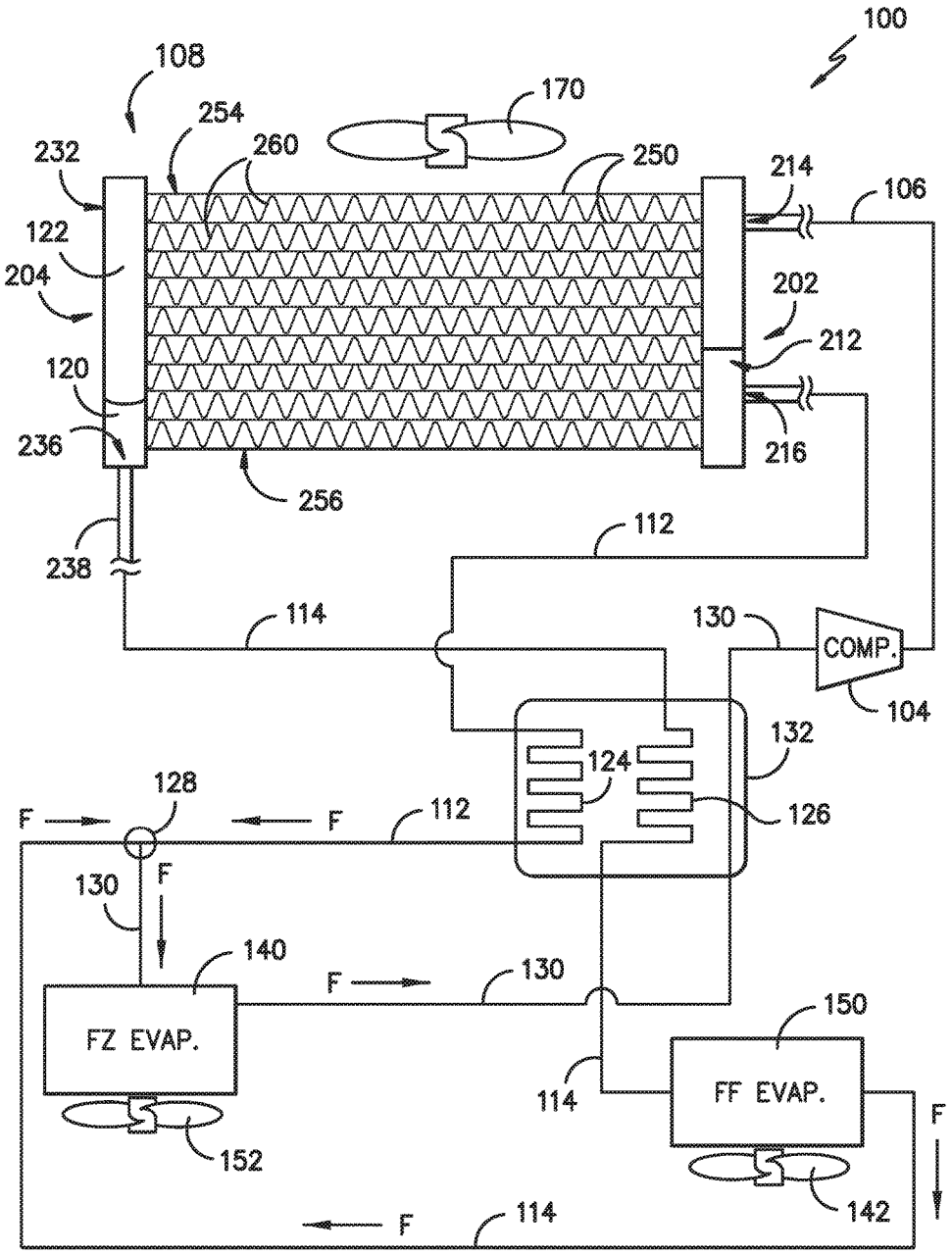

Turning now to FIG. 3, for this exemplary embodiment, first refrigerant stream 112 and second refrigerant stream 114 are received by first expansion device 124 and second expansion device 126, respectively, as previously described. Second evaporator 150 is configured to receive and evaporate at least a portion of the second refrigerant stream 114 from second expansion device 126 so as to provide cooling as previously described.

In this embodiment, junction 128 joins first refrigerant stream 112 from first expansion device 124 and second refrigerant stream 114 from second evaporator 150 to provide a combined refrigerant stream 130 to first evaporator 140. In turn, first evaporator 140 is configured to receive and evaporate at least a portion of combined refrigerant stream 130 and provide an inlet refrigerant flow 130 to compressor 104. As previously described, block 132 represents thermal communication between first and second expansion devices 124 and 126 and inlet refrigerant flow 130 so as to cool first refrigerant stream 112 and second refrigerant stream 114. Compressor 104 is used to pressurize refrigerant flow 130 and repeat the cycle as previously described.

In addition to other advantages, the exemplary embodiment of refrigeration system 100 depicted in FIG. 3 can also provide advantages in the layout or construction of plumbing and/or components in a refrigerator appliance such as refrigerator 10. Also, the embodiment of FIG. 3 may be useful where e.g., less cooling is required for fresh food FF compartment 12. Thus, some of the cooling capacity of first refrigerant stream 114 from second evaporator 150 is used in first evaporator 140 to cool e.g., the frozen food FZ compartment 14.

Figure 4:
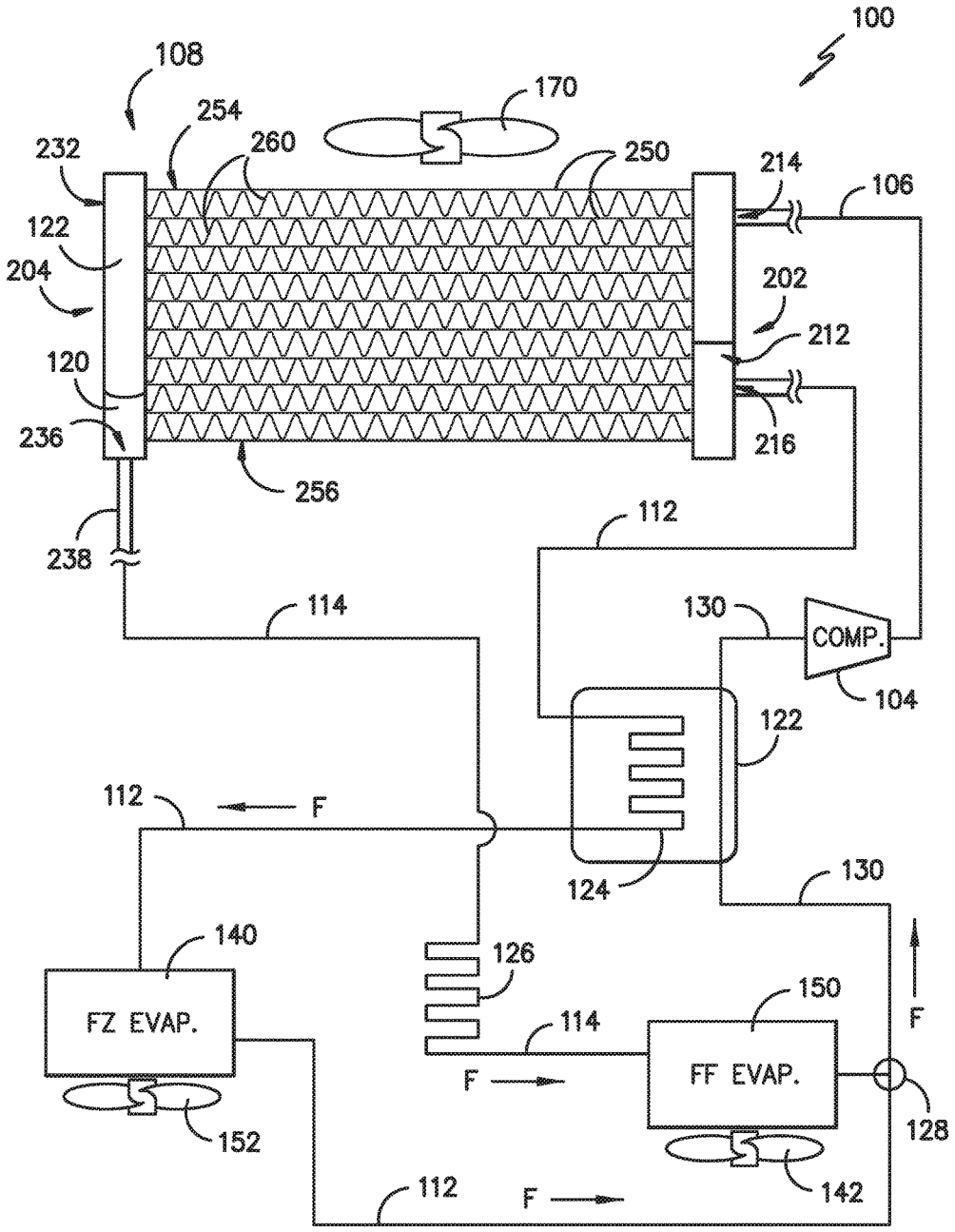

Referring now to the exemplary embodiment of system 100 as shown in FIG. 4, first refrigerant stream 112 and second refrigerant stream 114 are received by first expansion device 124 and second expansion device 126, respectively, as previously described. In this embodiment, first evaporator 140 is configured to receive and evaporate at least a portion of the first refrigerant stream 112 from first expansion device 124. Second evaporator 150 is configured to receive and evaporate at least a portion of the second refrigerant stream 114 from second expansion device 126. A junction 128 combines first refrigerant stream 112 from first evaporator 140 with second refrigerant stream 114 from second evaporator 150 to provide an inlet refrigerant flow 130 to compressor 104. Compressor 104 is used to pressurize inlet refrigerant flow 130 and repeat the cycle as previously described.

At block 122, first expansion device 124 is in thermal communication with inlet refrigerant flow 130 to compressor 104 but not with second expansion device 126. This configuration can allow a greater change in enthalpy for the refrigerant stream 112 to first evaporator 140 as it will be further cooled in first expansion device 124. Thus, for an appliance 10 where first evaporator 140 provides cooling to freezer compartment 14, more cooling can be provided to compartment 14. This will also result in less required refrigerant flow 112 to first evaporator 140 and but more for second evaporator 150 in e.g., fresh food compartment 12. Cooling with second evaporator 150 in the fresh food compartment 12 will likely be at a higher efficiency, however.

Figure 5:
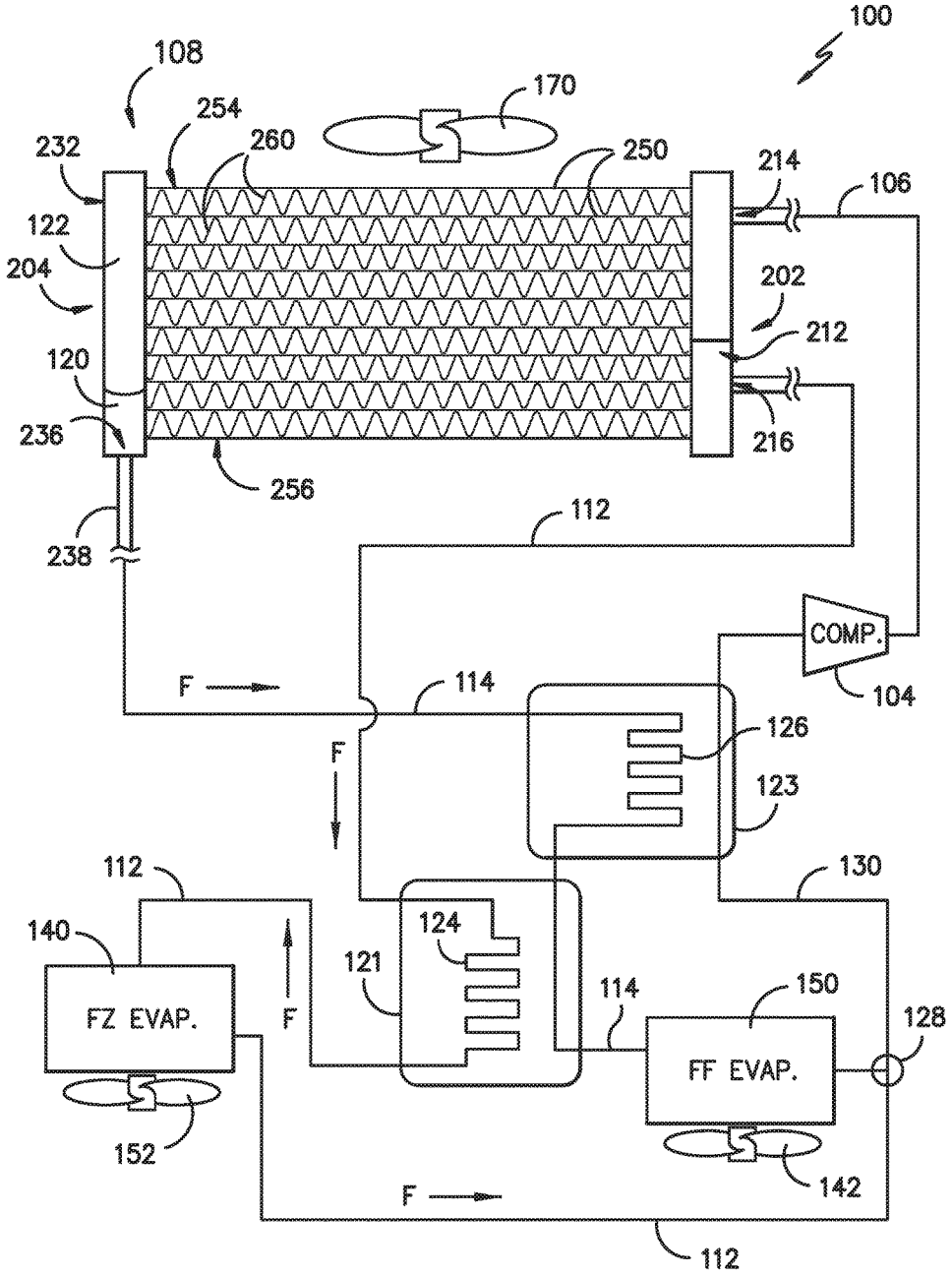

Referring to FIG. 5, in the this exemplary embodiment of refrigeration system 100, first refrigerant stream 112 and second refrigerant stream 114 are received by first expansion device 124 and second expansion device 126, respectively, as previously described. First evaporator 140 is configured to receive and evaporate at least a portion of the first refrigerant stream 112 from first expansion device 124. Second evaporator 150 is configured to receive and evaporate at least a portion of the second refrigerant stream 114 from second expansion device 126. A junction 128 combines first refrigerant stream 112 from first evaporator 140 with second refrigerant stream 114 from second evaporator 150 to provide an inlet refrigerant flow 130 to compressor 104. Compressor 104 is used to pressurize inlet refrigerant flow 130 and repeat the cycle as previously described.

As represented by block 123, second refrigerant stream 114 in second expansion device 126 is in thermal communication with the inlet refrigerant flow 130 to compressor 104 so as to cool second refrigerant stream 114. Additionally, as represented by block 121, first refrigerant stream 114 in first expansion device 124 is in thermal communication with second refrigerant stream 114 from second expansion device 126. System 100 as shown in FIG. 5 facilitates e.g., the use of a high temperature glide refrigerant mixture because first refrigerant stream 112 in first expansion device 124 is further cooled by refrigerant stream 114 after stream 114 has passed through second expansion device 126. As such, the cooling capacity of refrigerant stream 114 travelling to second evaporator 150 in e.g., the fresh food (FF) compartment 12 is decreased while the cooling capacity of the refrigerant stream 112 travelling to first evaporator 140 in the frozen food (FZ) compartment 14 is increased. However, second evaporator 150 in the fresh food compartment 12 will provide cooling more efficiently.

In the exemplary embodiments described above, refrigeration system 100 can be constructed with fewer parts in that e.g., no damper, no refrigerant flow valve and no check valve are needed. The manufacturing of refrigeration system 100 can be simpler and more repeatable. Additionally, there are no cycling losses when switching refrigerant between fresh food and freezer evaporators as occurs in certain existing dual evaporator systems. Further, the split refrigerant flow can reduce the need for large evaporators because both evaporators are used simultaneously. The smaller evaporators can require less internal volume versus a traditional dual evaporator system. Further, the system 100 can eliminates issues with very short fresh food cooling cycles such as temperature and humidity management.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration system, comprising:

a zeotropic refrigerant for circulation within the refrigeration system;

a compressor for providing a pressurized flow of the refrigerant;

a microchannel condenser configured to receive and cool the flow of pressurized refrigerant, the microchannel condenser comprising:

a first header, the first header comprising a body defining an interior and further defining an inlet bore and a first outlet bore;

a second header spaced apart from the first header, the second header comprising a body defining an interior and further defining a second outlet bore; and a plurality of tubes extending between the first header and the second header, each of the plurality of tubes defining a plurality of microchannels, each of the plurality of microchannels in fluid communication with the interior of the first header and the interior of the second header, each of the plurality of microchannels having a maximum cross-sectional width of less than or equal to 5 millimeters;

wherein the pressurized refrigerant is separated in the interior of the second header into a first refrigerant stream and a second refrigerant stream, the first refrigerant stream flowable from the interior of the second header into the microchannels of a portion of the plurality of tubes, the second refrigerant stream flowable from the interior of the second header through the second outlet bore;

a first expansion device in receipt of the first refrigerant stream from the condenser and configured for reducing the pressure of the first refrigerant stream; and a second expansion device in receipt of the second refrigerant stream from the condenser and configured for reducing the pressure of the second refrigerant stream;

a first evaporator configured to receive and evaporate at least a portion of the first refrigerant stream; and a second evaporator configured to receive and evaporate at least a portion of the second refrigerant stream.

2. The refrigeration system of claim 1, wherein the plurality of tubes comprises a first portion of tubes and a second portion of tubes, wherein the pressurized refrigerant is flowed from the first header to the second header through the first portion of tubes and flowed from the second header to the first header through the second portion of tubes.

3. The refrigeration system of claim 1, wherein the first header further comprises a partition disposed within the interior and dividing the interior into a first interior portion and a second interior portion.

4. The refrigeration system of claim 1, wherein the maximum cross-sectional width is less than or equal to 3 millimeters.

5. The refrigeration system of claim 1, wherein the first expansion device and the second expansion device each comprise a capillary tube.

6. A refrigeration system as in claim 1, wherein the pressure of the first refrigerant stream is substantially equal to the pressure of the second refrigerant stream.

7. The refrigeration system of claim 1, wherein the zeotropic refrigerant comprises two or more refrigerants selected from a group consisting of an R-134a refrigerant, an R-245fa refrigerant, an R-245ca refrigerant, an R-1234yf refrigerant, an R-600 refrigerant, an R-600a refrigerant, ethane, pentane, butane, and propane.

8. The refrigeration system of claim 1, further comprising a junction that joins the first refrigerant stream from the first evaporator and the second refrigerant stream from the second expansion device into a combined refrigerant stream, and wherein the second evaporator is configured to receive and evaporate at least a portion of the combined refrigerant stream and provide an inlet refrigerant flow to the compressor.

9. The refrigeration system of claim 1, further comprising a junction that joins the first refrigerant stream from the first expansion device and the second refrigerant stream from the second evaporator to provide a combined refrigerant stream to the first evaporator, wherein the first evaporator is configured to receive and evaporate at least a portion of the combined refrigerant stream and provide an inlet refrigerant flow to the compressor.

10. The refrigeration system of claim 1, further comprising a junction that combines the first refrigerant stream from the first evaporator with the second refrigerant stream from the second evaporator to provide an inlet refrigerant flow to compressor.

11. The refrigeration system of claim 1, wherein the first and second expansion devices are in thermal communication with the inlet refrigerant stream to the compressor so as to cool the first refrigerant stream and the second refrigerant stream.

12. The refrigeration system of claim 1, wherein the first expansion device is in thermal communication with the inlet refrigerant flow to the compressor so as to cool the first refrigerant stream.

13. The refrigeration system of claim 1, wherein the second expansion device is in thermal communication with the inlet refrigerant stream to the compressor so as to cool the second refrigerant stream.

14. The refrigeration system of claim 1, wherein the second expansion device is in thermal communication with the inlet refrigerant stream to the compressor so as to cool the second refrigerant stream, and the first expansion device in in thermal communication with the second refrigerant stream from the second expansion device so as to cool the first refrigerant stream.

15. A microchannel condenser for receiving and cooling a flow of pressurized refrigerant, the microchannel condenser comprising:

a first header, the first header comprising a body defining an interior and further defining an inlet bore and a first outlet bore;

a second header spaced apart from the first header, the second header comprising a body defining an interior and further defining a second outlet bore;

a conduit in fluid communication with the second outlet bore; and a plurality of tubes extending between the first header and the second header, each of the plurality of tubes defining a plurality of microchannels, each of the plurality of microchannels in fluid communication with the interior of the first header and the interior of the second header, each of the plurality of microchannels having a maximum cross-sectional width of less than or equal to 5 millimeters.

16. The microchannel condenser of claim 15, wherein the second outlet bore is defined in a bottom wall of the second header.

17. The microchannel condenser of claim 15, wherein the plurality of tubes comprises a first portion of tubes and a second portion of tubes.

18. The microchannel condenser of claim 15, wherein the first header further comprises a partition disposed within the interior and dividing the interior into a first interior portion and a second interior portion.

19. The microchannel condenser of claim 15, wherein the maximum cross-sectional width is less than or equal to 3 millimeters.

* * * * *